United States Patent [19]

Bachmann

[11] Patent Number: 4,756,555

[45] Date of Patent: Jul. 12, 1988

[54] WING APPARATUS FOR SKIERS

[76] Inventor: William V. Bachmann, 22517 Ten Mile Rd., St. Clair Shores, Mich. 48080

[21] Appl. No.: 12,659

[22] Filed: Feb. 9, 1987

[51] Int. Cl.[4] ..... A63C 11/00

[52] U.S. Cl. ..... 280/810; 280/816; 280/819; 244/4 A

[58] Field of Search ..... 280/809, 810, 816, 819; 180/2.2, 180; 114/39.2; 244/4 A, 64, 900

[56] References Cited

U.S. PATENT DOCUMENTS

| | | | |
|---|---|---|---|
| 95,513 | 10/1869 | Quinby | 244/64 |
| 132,022 | 10/1872 | Quinby | 244/64 |
| 1,178,165 | 4/1916 | Lupton, Jr. | 280/810 |
| 1,859,178 | 5/1932 | Sprinkle | 280/810 |
| 2,213,754 | 9/1940 | Thirring | 280/810 |
| 3,047,302 | 7/1962 | Krylov | 280/810 |
| 3,830,512 | 8/1974 | Spiegel | 280/810 |
| 3,924,870 | 12/1975 | Spivack et al. | 280/810 |
| 4,204,694 | 5/1980 | Freeman | 280/810 |
| 4,311,324 | 1/1982 | Fries | 280/810 |
| 4,531,763 | 7/1985 | Toland | 280/810 |

FOREIGN PATENT DOCUMENTS

| | | | |
|---|---|---|---|
| 0169440 | 11/1951 | Austria | 280/810 |
| 222136 | 5/1906 | Fed. Rep. of Germany | 244/64 |
| 2310563 | 9/1974 | Fed. Rep. of Germany | 280/810 |
| 1528013 | 6/1968 | France | 280/810 |
| 2515136 | 4/1983 | France | 114/39.2 |

OTHER PUBLICATIONS

Popular Mechanics Article, "Austrian's Ski-Sail Permits Long Leaps", Jan. 1953, p. 155.

Book, "Der Schwelbelauf", Hans Thirring, Copyright 1939 (Germany), Cover Pages & p. 16.

"Skiing" Magazine; Oct. 1986; p. 19.

"Manbirds", Maralys Wills; Prentice Hall, Inc.; Cover Pages and p. 43; Publication date unknown.

*Primary Examiner*—David M. Mitchell

*Assistant Examiner*—Brian L. Johnson

*Attorney, Agent, or Firm*—Lon H. Romanski

[57] ABSTRACT

Apparatus for creating aerodynamic lift to a downhill skier is shown as having a harness adapted to be worn by the skier, a left wing structure is operatively carried by the harness, a right wing structure is operatively carried by the harness, the left wing structure has a first longitudinal axis extending generally transversely of the skier, the right wing structure has a second longitudinal axis extending generally transversely of the skier, the left wing structure is selectively rotatable about the first longitudinal axis, the right wing structure is selectively rotatable about the second longitudinal axis, and the left and right wing structures are respectively rotatable about the first and second axes independently of each other by the skier to respective selected positions.

33 Claims, 7 Drawing Sheets

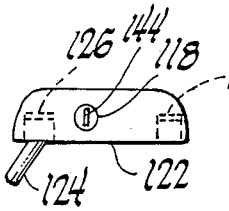
Fig 12
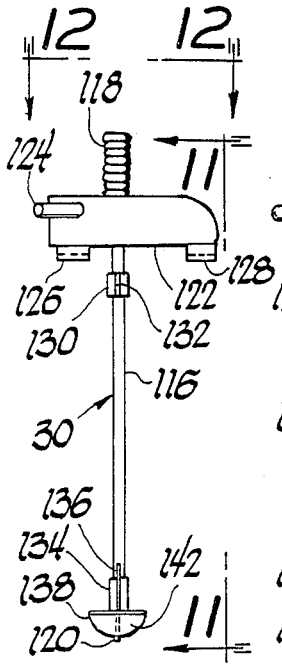
Fig 10
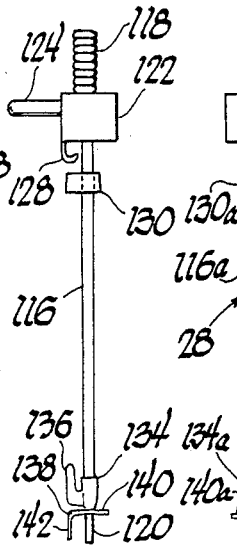
Fig 11
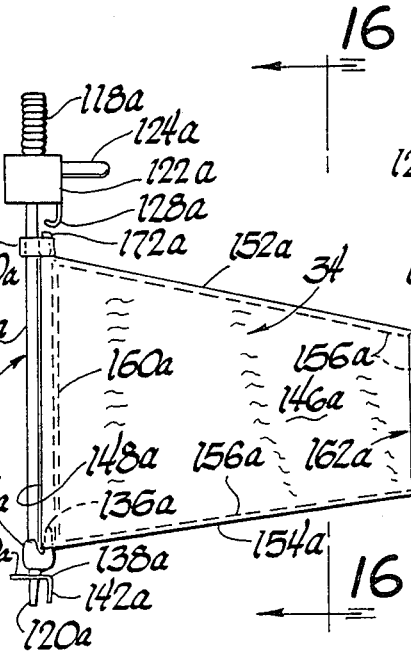
Fig 15
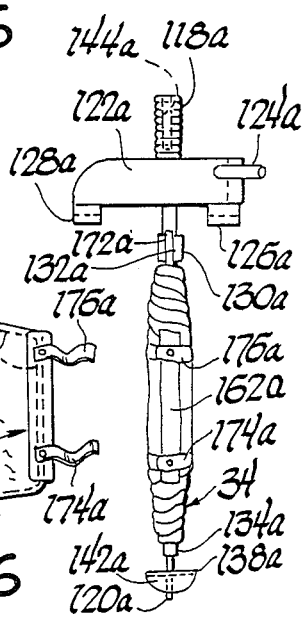
Fig 16
Fig 14
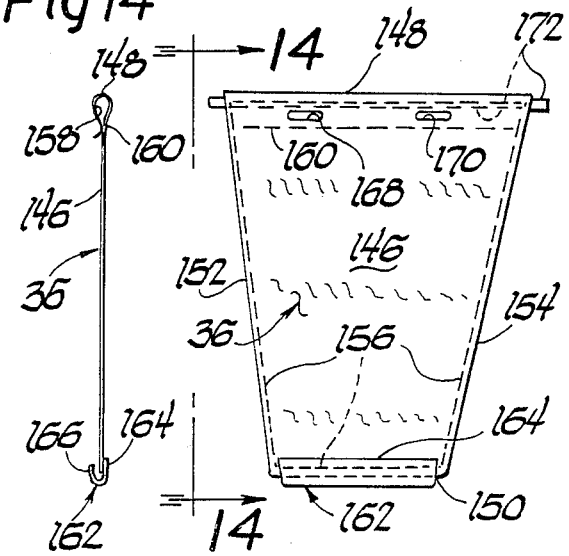
Fig 13
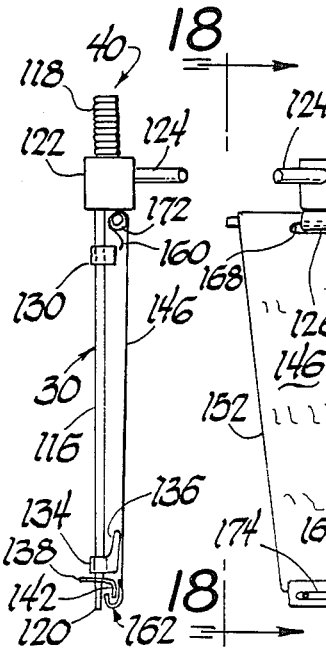
Fig 18
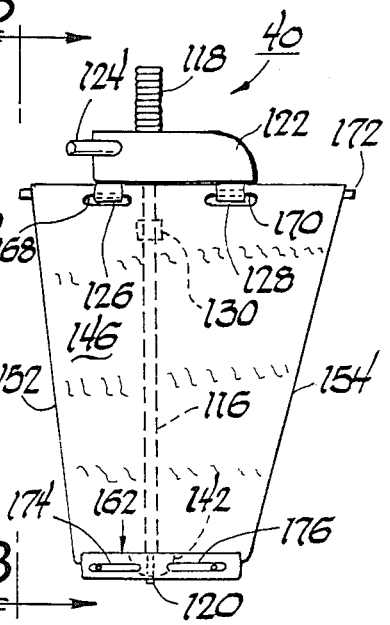
Fig 17

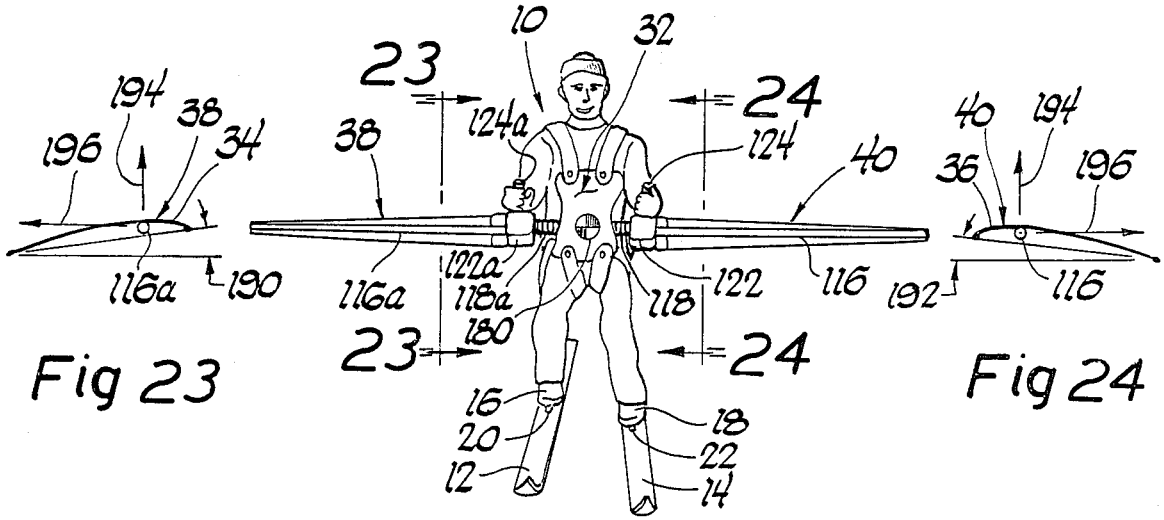
Fig 23
Fig 24
Fig 22
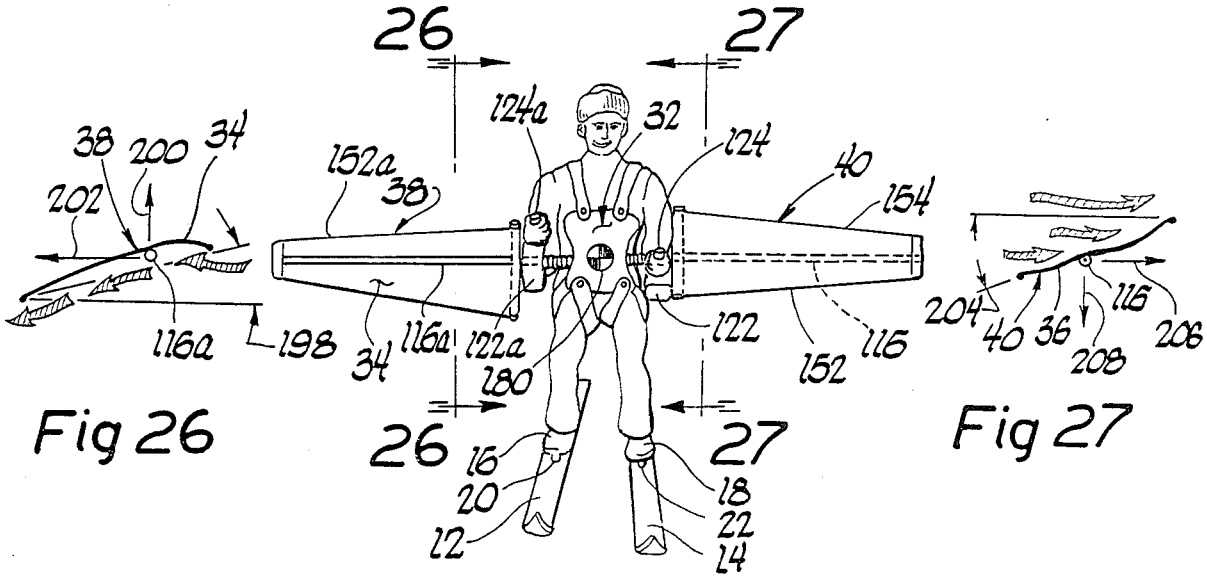
Fig 26
Fig 27
Fig 25

WING APPARATUS FOR SKIERS

FIELD OF THE INVENTION

This invention relates generally to wing apparatus primarily for use by snow skiers and more particularly by alpine or downhill skiers for achieving, among other things, the sensation of flying without the necessity of having the skier's skis lose contact with the ground snow.

BACKGROUND OF THE INVENTION AND PRIOR ART STATEMENT

Heretofore, the prior art has made many attempts to provide various forms of apparatus employable in the sports of skiing and/or skating for using or creating some aerodynamic lifting and/or braking forces or effects.

Some of such prior art apparatus or devices were intended to be employable in both of such sports. For example, various forms of sail devices have been suggested whereby either the skater or skier would be propelled by the wind. Obviously, with such prior art devices, employed for using the wind to propel the skier and/or skater, no aerodynamic lift could be produced.

U.S. Pat. No. 1,178,165 dated Apr. 4, 1916, and issued to B. M. Lupton, Jr., discloses an appliance comprised of generally triangular sail panels which are adapted to be secured to the skater's body as to have, in each sail, the shorter edge of the sail panel extending from a point adjacent the skater's body to the skater's hand or wrist while the longer edge of the sail panel extends downwardly from the shorter edge to an area of the skater's ankle to which the sail panel is secured thereby resulting in a flexible bat-like triangular wing panel (or panels) whenever the skater extends an arm (or arms).

U.S. Pat. No. 1,859,178 dated May 17, 1932, and issued to S. A. Sprinkle, discloses a hand-held (folding) T-shaped main frame on which a triangular sail is mounted. After assembly, a skater obtains a wind propelling force as by holding the sail assembly along and on the windward side of the skater's body.

U.S. Pat. No. 3,047,302 dated July 31, 1962, and issued to C. A. Krylov, discloses another form of hand-held apparatus comprising a propeller like structure which is hand-held, as by the skier, to be forwardly of the skier.

U.S. Pat. No. 3,924,870 dated Dec. 9, 1975, and issued to Mayer Spivack et al, discloses another form of hand-held sail for use by a skater in obtaining a wind driven propelling force.

U.S. Pat. No. 4,204,694 dated May 27, 1980, and issued to J. L. Freeman, discloses two types of mast-carried sails for use by any of a skier, skater or iceboater for obtaining a wind driven propelling force. One of such sails is of the lateen configuration while the other is comprised of separate forward and aft sails each of which extending spar. The mast, in either case, can be supported as on one ski of a skier's pair of skis, on one skating shoe assembly of a skier's pair of skating shoe assemblies, or on apparatus defining an iceboat.

U.S. Pat. No. 4,311,324 dated Jan. 19, 1982, issued to J. E. Fries, illustrates an appliance not unlike that disclosed by said U.S. Pat. No. 1,178,165 to Lupton, Jr. (cited as a prior art reference). In this U.S. Pat. No. 4,311,324 the generally triangular panels, while being respectively secured at their lower apexes to the skater's ankles, are carried at their upper edges by common pole means which the skater, in turn, holds in an upper disposed generally horizontal position. Again, this device is employed by the skater for obtaining a wind driven propelling force.

Other prior art devices have been proposed primarily for use in the sport of skiing and such were, for all practical purposes, limited in use to downhill runs. In the main, such devices were various forms of sails to be used by the skier as aerodynamic braking means.

U.S. Pat. No. 2,213,754 dated Sept. 3, 1940, and issued to H. Thirring, discloses a cloak-like garment secured along the arms and legs of the skier and so shaped that, as seen from the front, when the skier stretches-out his arms laterally a trapezoidal or triangular air baffle sail is spread out between the skier's hands and legs with the hands still being free to hold the ski poles.

U.S. Pat. No. 3,830,512 dated Aug. 20, 1974, and issued to Bernt Spiegel, discloses a fabric-like braking sail of a generally convex top and side edges and arranged so that the baffle-like sail is arched substantially spherically by air flow with the greatest bulge in the lower portion. The sail is provided with handles at its upper corners, for gripping by the skier's hands, and detachable latches at the lower corners for attachment to the skis or boots of a skier.

U.S. Pat. No. 4,531,763 dated July 30, 1985, and issued to D. A. Toland, discloses an aerodynamic braking sail-like device having halves of equal area which are symmetrical about a central vertical axis and are balanced when held in the apparent wind created during a skier's downhill run. The sail has straight outer edges remote from the axis and hems along the edges forming sheaths to receive ski poles or the like. The sheaths leave central areas in which the ski poles can be gripped and the position of the grips is such that the areas above and below the line of the grips are equal so that the skier can effect counterbalancing of the apparent wind forces above and below the line. Indented pockets or balloon areas are intended to enhance the braking effect and provide more effective balance and speed control. In use, the sail is held taut between the skier's outstretched hands and, with the counterbalancing of the forces and ease of manipulation of the sail, easy and effective control of the skier's descent is said to be accomplished.

French Pat. No. 1,528,013 granted Apr. 29, 1968 (published June 7, 1968), to M. Dupuy discloses a baffle-like wing device for a braking effect. The device comprises generally laterally and vertically extending wing-like portions which are grasped at their upper ends by the skier's hands while a lower disposed medially situated portion is secured as by a belt, or the like, to the skier's waist. The wing-like portions, along their outer side edges, taper generally from a widest portion near the upper ends to a narrowest portion near the lower ends at a distance considerably below the skier's waist.

On page 19 of the October, 1986, issue of "Skiing" Magazine bearing a U.S.A. copyright notice of 1986 by CBS Magazines, a Division of CBS, Inc. (having an address of: 3460 Wilshire Blvd., Los Angeles, Calif.) a photograph and an accompanying brief statement appear relating to a "Ski Wings" invented by one David Toland. As stated therein, the device is intended to provide air cushion cruise control (air braking) for downhill runs. The structure, as understood, is not unlike the other prior art structures hereinbefore discussed.

The foregoing group of prior art patents, starting with said U.S. Pat. No. 2,213,754, disclose apparatus or devices principally suitable for only one purpose, that being, to serve as an aerodynamic brake to help slow a fast-running downhill skier. However, such aerodynamic braking devices are inconvenient in use, not significantly effective for their intended purpose and, further, they interfere with or even prevent the skier from executing various interesting and pleasurable skiing movements and techniques.

The prior art has also, heretofore, proposed various apparatus and devices for having a skier achieve flight while wearing skis.

Austrian Pat. No. 169,440 dated Nov. 10, 1951, and issued to N. Martinak, discloses apparatus, intended for creating flight, comprising two triangular fabric wing-like panels laterally spaced from each other and interconnected at their inner apexes as by belt or strap means. The outer-most edges of the wing-like panels are of sheath-like configuration which respectively accept the skier's ski poles. It is asserted that when the skier, thusly equipped, holds his arms outstretched while still holding the ski poles aerodynamic lift can be achieved. However, this, as a practical matter is unattainable because, first, the total area of the wing-like panels would be too small to create any significant aerodynamic lift and, second, the magnitude of the resulting torque applied to the skier's outstretched arms would be unbearable to the skier. Further, to require the skier, as such apparatus does, to ski with his arms outstretched and holding ski poles is contrary to any useful skiing technique.

German patent document (Offenlegungsschrift) No. 2,310,563 published Sept. 5, 1974, of Gerhard Hanik, discloses a multi-wing structure to be worn on the upper back of a skier's body. The overall structure may have from two to fifteen load-bearing wing-like members secured to an intermediate attachment frame which has a general contour of a butterfly with spread wings. Such attachment frame is secured to the skier's back at an area near the skier's shoulders as to have at least certain of the wing-like members at an elevation at least above shoulder height. It is intended that in use the skier must lean significantly forward, at the waist, to thereby expose all of the wing-like members to the apparent wind. Even assuming that such an apparatus would be functional, the skier, wearing a cluster of small wing-like members situated generally above him (while leaning forwardly), will hardly feel comfortable or natural in his skiing techniques and maneuvers.

In book entitled "Der Schwebelauf" (The Soaring Run), authored by Dr. Hans Thirring and bearing a copyright notice of 1939 in Germany, describes a real wing structure of dimensions large enough for actually lifting a skier, employing such a wing structure, off the ground. However, with such a wing structure once the skier was airborne the skier could not control the wing as to assure either a stable flight or a safe landing.

In a publication "Manbirds" (Hang Gliders & Hang Gliding) published by Prentice-Hall, Inc. of Englewood, N.J., there is a photograph, and brief written description, of one Willie Muller who in 1971 combined skiing with hang gliding. As a consequence of such a general arrangement, the skier could take-off from a steep slope and be airborne. However, for so long as the skier was airborne, the skier could not use his skiis and therefore during such time was not actually engaged in skiing but rather in airborne gliding. After landing, a skier, employing such a hang glider, is presented with the problem of having to somehow transport the hang glider (which may weigh 80 lbs.) back-up the snow-covered hill.

As discussed, such prior art devices can be broadly grouped into two catagories the first being that group or catagory in which the wing structure, although making the skier airborne, provides no means by which the skier can control the wing structure as to assure either a stable flight or a safe landing. The second group or catagory would include devices as the hang glider wing structures which do provide for control by the skier to, at least to a significant degree, assure stable flight and a safe landing. However, among other problems attendant such prior art structures, in both catagories the skier, while airborne, is not actually skiing. Further while employing such prior art wing structures it is a practical impossibility for a skier to actually ski in any normal fashion.

SUMMARY OF THE INVENTION

According to the invention, apparatus for creating aerodynamic lift to a downhill skier comprises harness means adapted to be worn by said skier, a left wing structure operatively carried by said harness means, a right wing structure operatively carried by said harness means, said left wing structure having a first longitudinal axis extending generally transversely of said skier, said right wing structure having a second longitudinal axis extending generally transversely of said skier, wherein said left wing structure is selectively rotatable about said first longitudinal axis, wherein said right wing structure is selectively rotatable about said second longitudinal axis, and wherein said left and right wing structures are respectively rotatable about said first and second axes independently of each other by said skier to respective selected positions.

Various general and specific obiects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views:

FIG. 10 is an elevational view of one of the elements shown in FIGS. 2 and 3 and more particularly identified as the skier's left hand ski pole embodying teachings of the invention;

FIG. 11 is a view, of the ski pole of FIG. 10, taken generally on the plane of line 11—11 of FIG. 10 and looking in the direction of the arrows;

FIG. 12 is a view taken generally on the plane of line 12—12 of FIG. 10 and looking in the direction of the arrows;

FIG. 13 is what may be considered a top plan view of a wing sub-assembly, embodying teachings of the invention, intended for use as a skier's left wing panel;

FIG. 14 is a view taken generally on the plane of line 14—14 of FIG. 13 and looking in the direction of the arrows;

FIG. 15 is what may be considered a bottom plan view of a wing sub-assembly, embodying teachings of the invention and intended for use as a skier's right wing panel with such being shown operatively connected at its inner end, as at the initiation of its stored condition, to the skier's right hand ski pole, shown in elevation, and also employing teachings of the invention;

FIG. 16 is a view of the ski pole of FIG. 15 taken generally on the plane of line 16—16 of FIG. 15 and with the ski wing panel of FIG. 15 being totally wrapped about such ski pole as to be in its fully stored condition on the ski pole;

FIG. 17 is a view of the ski pole shown in FIG. 10 with the wing panel means of FIG. 13 secured thereto as to form an operational wing assembly;

FIG. 18 is a view taken generally on the plane of line 18—18 of FIG. 17 and looking in the direction of the arrows;

FIG. 22 is a front elevational view of a skier as shown in FIG. 4 except that the skier in FIG. 22 is depicted as having selectively manually adjusted both the left and right (skier's left and right) wing structures, embodying teachings of the invention, as to have each at generally the same positive angle of attack as to thereby achieve generally equal aerodynamic lift on both of such wing structures;

FIG. 23 is a cross-sectional view taken generally on the plane of line 23—23 of FIG. 22 and looking in the direction of the arrows;

FIG. 24 is a cross-sectional view taken generally on the plane of line 24—24 of FIG. 22 and looking in the direction of the arrows;

FIG. 25 is a view similar to that of FIG. 22 except that in FIG. 25 the skier is depicted as having adjusted the skier's right wing structure to a substantially increased angle of attack and as having adjusted the skier's left wing structure as to have the leading edge thereof lowered to an elevation substantially lower than the trailing edge of such left wing structure;

FIG. 26 is a cross-sectional view taken generally on the plane of line 26—26 of FIG. 25 and looking in the direction of the arrows;

FIG. 27 is a cross-sectional view taken generally on the plane of line 27—27 of FIG. 25 and looking in the direction of the arrows;

DETAILED DESCRIPTION OF THE PREFERRED EMBODIMENT

Figure 1:
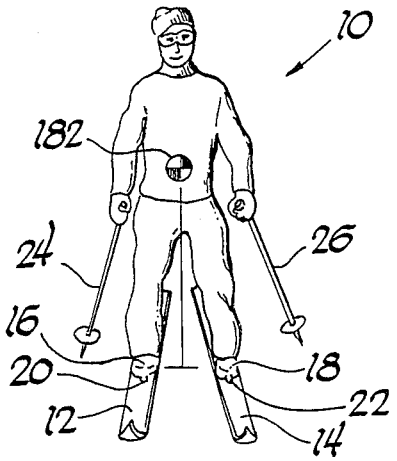
Fig 1 PRIOR ART
FIG. 1 is a front elevational view of a skier with conventional or prior art equipment.

Referring now in greater detail to the drawings, FIG. 1 illustrates a skier 10 employing, exclusively, prior art downhill type skiing equipment as, for example, right and left skis 12 and 14, right and left ski boots 16 and 18, right and left ski boot bindings 20 and 22 and right and left ski poles 24 and 26. (By way of clarification, and except as specifically noted to the contrary, the terms "right" and "left" as used herein refer to the skier's right and left. Further, like elements in the various Figures are identified with like reference numbers.)

Figure 2:
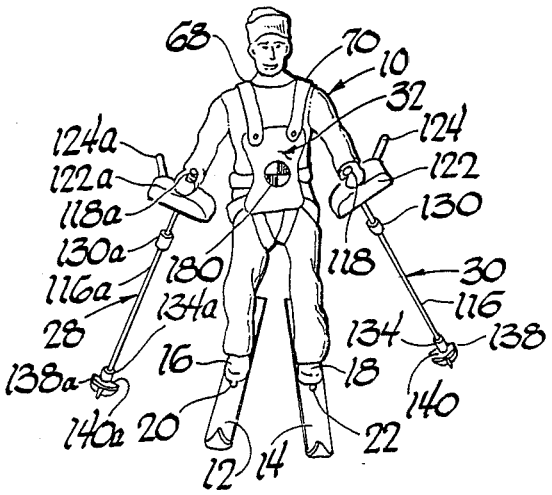
FIG. 2 is a front elevational view of a skier equipped with apparatus employing teachings of the invention.

In comparison, FIG. 2 depicts the same skier 10 but equipped with some of the prior art structure shown in FIG. 1 and equipped with apparatus employing teachings of the invention. More particularly, in FIG. 2, the skier 10 is employing a right ski pole assembly 28 and a left ski pole assembly 30, each employing teachings of the invention, and is wearing a harness assembly 32 which also employs teachings of the invention. As should be apparent, the skier 10 of FIG. 2, with the equipment and apparatus depicted therein, is still able to complete skiing maneuvers as when equipped with exclusively the prior art apparatus of FIG. 1.

Figure 3:
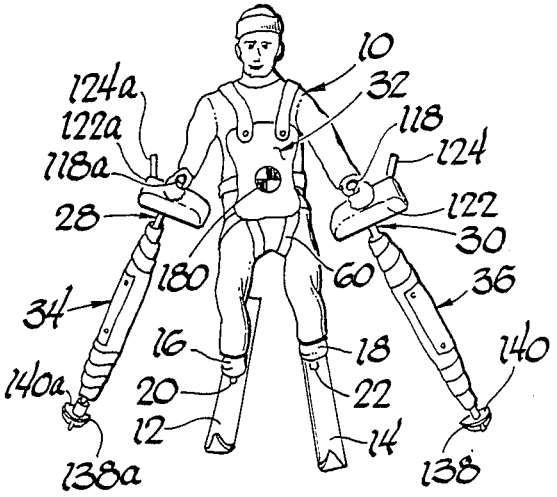
FIG. 3, similar to FIG. 2, is a front elevational view of a skier equipped with additional apparatus employing teachings of the invention.

FIG. 3 illustrates the same skier 10, as in FIG. 2, but now provided with ski wing panels 34 and 36, employing teachings of the invention, which are respectively wrapped in a stored condition about ski pole assemblies 28 and 30. The ski wing panels 34 and 36 are very light in weight and, in their wrapped condition, are not bulky thereby, as depicted in FIG. 3, permitting normal use of the ski pole assemblies 28 and 30 by the skier 10. A special feature of thusly having the wing panels 34 and 36 stored on the ski poles 28 and 30 is that it provides for ease of transportation especially when the skier is using uphill transportation as, for example, ski lifts, gondolas, cable cars, helicopters and the like.

Figure 4:
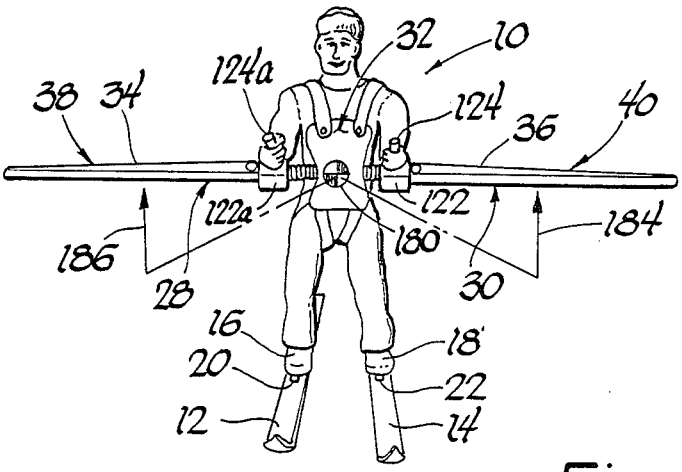
FIG. 4 is a front elevational view of a skier with the apparatus depicted in FIG. 3 being assembled and the skier now being ready for use of such assembled apparatus as for a downhill ski run.

FIG. 4 illustrates the same skier 10, as in FIG. 3, but now with the elements of FIG. 3 being assembled, converted into right and left skiing wing assemblies 38 and 40 which are, in turn, operatively connected to the skier's body as through the harness means 32.

Referring in greater detail to FIGS. 5, 6, 7, 8 and 9 the harness assembly 32 is illustrated as comprising a rigid main body or plate 42 which at its lower end is provided with right and left attachment posts 44 and 46 and, similarly, at its upper end is provided with right and left attachment posts 48 and 50 with each of such attachment posts being fixedly secured to the plate 42. Further, right and left hook-like members or anchors 52 and 54 are fixedly secured to the plate 42 as to be situated on the forward face or surface 56 of plate or body 42.

Figure 5:
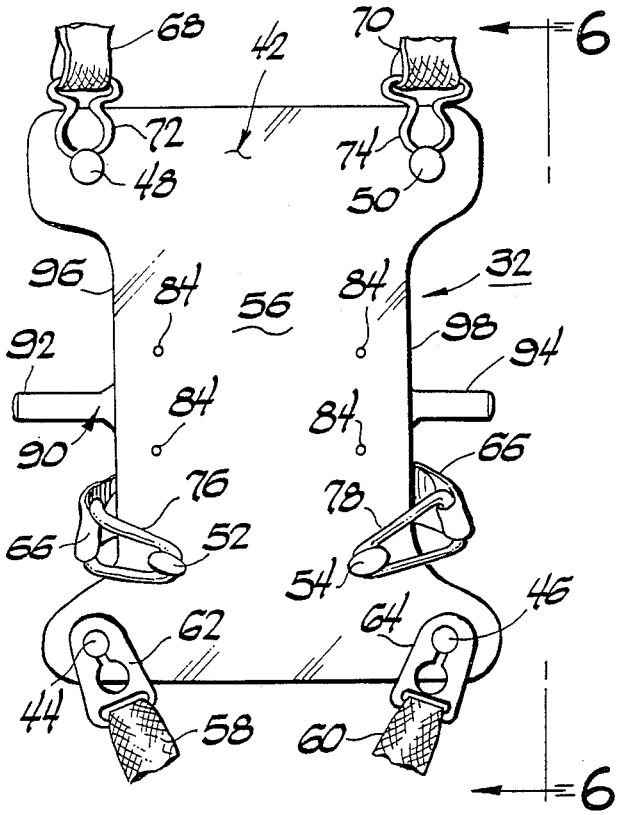
FIG. 5 is a front elevational view of the harness plate of FIGS. 2, 3 and 4 with fragmentarily illustrated associated harness straps.
Figure 6:
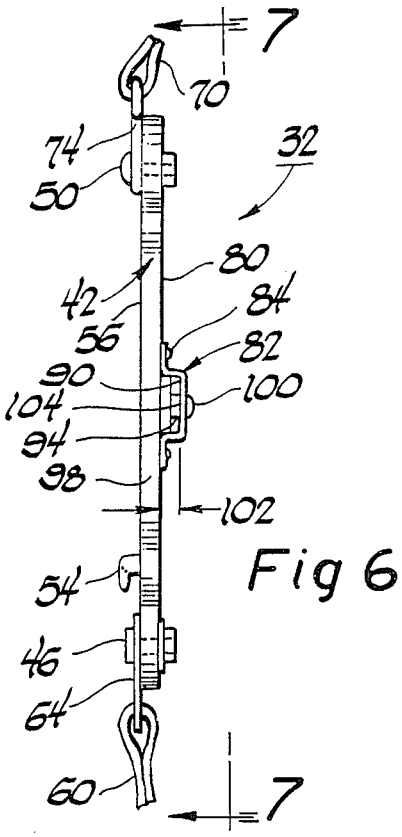
FIG. 6 is a view taken generally on the plane of line 6—6 of FIG. 5 and looking in the direction of the arrows.

A pair of underslung harness belts 58 and 60 are respectively provided with slotted buckle plates 62 and 64 which, as depicted, are respectively operatively detachably secured to anchor posts 44 and 46. As will become apparent, such belts 58 and 60 are intended to be passed as between the skier's legs or wrapped about the skier's legs, depending primarily on the skier's choice, with the respective opposite ends of such belts 58 and 60 then being suitably secured as to a generally transversely positioned harness belt 66 serving to generally encircle the skier's waist. A pair of shoulder or suspender type harness belts or straps 68 and 70 are respectively provided at their first ends with buckle means 72 and 74 which, in turn, are effective for latching engagement with anchoring or securing posts 48 and 50. The main or girding harness belt or straps 66 is preferably provided at its opposite ends with latching members or buckles 76 and 78 which, as generally depicted in FIGS. 5 and 8, respectively latchingly engage retainer posts 52 and 54.

The rear or inner surface 80 of the breast plate 42 has a bracket means 82 secured thereto as by, for example, a plurality of screws or rivets 84. The mounting bracket 82, which may be of suitable metal, is of a generally channel configuration, in cross-section, and provided with laterally extending flanges 86 and 88 through which the shanks of the screws or rivets 84 extend.

A torsion bar 90, comprising torsion means, has a relatively enlarged generally medially situated main body portion which is closely received within the bracket 82 as to have its relatively narrower oppositely disposed ends 92 and 94 extending from the bracket and somewhat beyond the relieved or cut-out side portions 96 and 98 of the mounting or breast plate 42. The torsion bar 90, depicted as being of generally flat stock material with such flatness continuing through the ends 92 and 94, may be secured to the mounting bracket 82 by any suitable means as, for example, screws 100. In the preferred arrangement, the bracket 82 is of such a dimension as to result in a spacing of at least 3.83 cm., as depicted at 102 of FIG. 6, between the inner channel surface 104 of bracket 82 and surface 80 of plate member 42.

Figure 8:
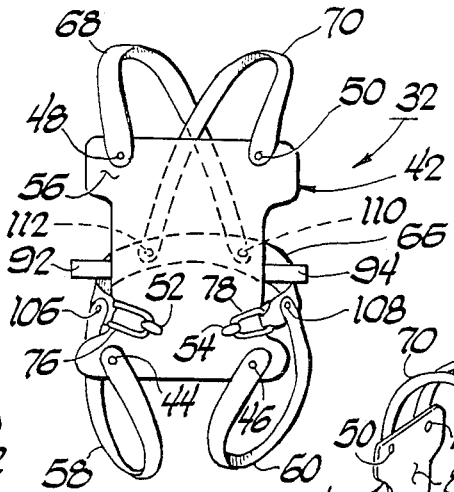
FIG. 8 is a front elevational view of a complete harness assembly employing teachings of the invention.
Figure 9:
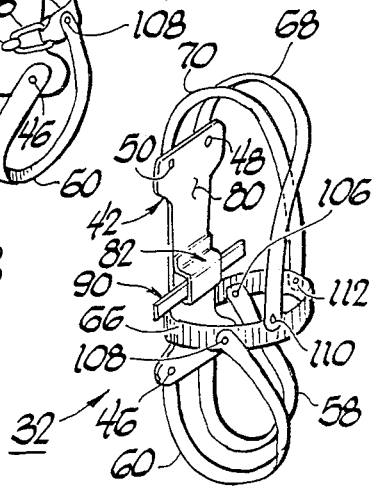
FIG. 9 is generally a perspective view of the harness assembly of FIG. 8.

As generally simplistically depicted in both FIGS. 8 and 9 the yet not described opposite ends of belts or straps 58, 60, 68 and 70 are each operatively secured to the waist or girding belt 66 as at 106, 108, 110 and 112. It is to be understood that such points or areas of attachment as at 106, 108, 110 and 112 may be either of a permanent or detachable type and, further, that any or all of the straps or belts 58, 60, 66, 68 and 70 may include suitable length adjustment means many of which are well known in the art even though for sake of clarity are not specifically disclosed.

Referring primarily to FIGS. 8 and 9, when the skier applies the harness assembly to the skier's torso, the skier may first place the breast or mounting plate against the skier's chest, as to locate the torsion bar bracket 82 somewhat below the skier's rib cage, at which time the main girding belt 66, passed about the skier's waist, is secured at its ends to anchors or posts 52 and 54, respectively. Next, the shoulder belts 68 and 70, first crossed along the skier's back, are looped over the skier's shoulders and respectively secured to anchor or latching posts 48 and 50. Straps or belts 58 and 60 are then passed generally behind and between the skier's legs and brought forwardly and upwardly and respectively secured to latching or anchor posts 44 and 46. Any and all of such straps may, of course, be adjusted for length as to firmly secure the harness assembly to the skier.

Referring in greater detail to FIGS. 10–18, in the preferred embodiment of the invention, the skier is provided with left and right hand ski pole assemblies 30 and 28 with the preferred embodiment of the left hand ski pole assembly 30 being depicted in FIGS. 10, 11, 12, 17 and 18 while the preferred embodiment of the right hand ski pole assembly 28 is depicted in FIGS. 15 and 16.

Referring primarily to FIGS. 10, 11 and 12, the left ski pole assembly 30 is depicted as comprising a ski pole 116 having at its generally upper end a skier's hand grip 118 and, at its lower end, a tip portion 120 which is employable by planting it into the snow as to perform various skiing maneuvers as is well known in the sport of skiing.

A cross-member or body 122 is secured to the ski pole 116 and the hand grip 118 preferably at a location axially immediately adjacent to the hand grip 118. The member 122 may be formed of any suitable material and may be of solid or hollow construction. A secondary left hand grip means 124 is preferably provided on body means 122 at a location which may be considered generally forwardly thereof and somewhat inclined as to have the free end of gripping means 124 generally forwardly disposed. Further, the cross-member 122 is preferably provided with a pair of retainer means 126 and 128 which, to some limited degree, may be somewhat resiliently deflectable. As best seen in FIG. 11, each of such retainer means may be of a hook-like configuration as generally depicted at 128.

Somewhat near the cross-member 122, the ski pole 116 is provided with a locking or latching means 130, suitably secured thereto against relative movement, having an axially extending opening 132 which may be resiliently openable to a greater opening for purposes to be described.

The ski pole 116 is provided with a second locking or retainer means 134, suitably secured thereto against relative movement, as near the lower end of pole 116. As best seen in FIG. 11, the retainer means 134 is preferably provided with a generally axially extending finger-like portion 136 which is preferably axially aligned with the slot-like opening 132 of retainer means 130.

A sturdy basket means 138 is also suitably fixedly secured to the ski pole 116 near its lower end and preferably outwardly of the lower retainer means 134. Referring to both FIGS. 10 and 11, it can be seen that in the preferred embodiment the basket means 138 is of a generally L-shaped configuration (as viewed in FIG. 11) having a first body portion 140 generally transverse to the pole 116 and a second body portion 142 depending downwardly therefrom generally parallel to and spaced from the axis of pole 116. As viewed in FIG. 10, body portion 142 is formed as to have its free edge preferably of an arcuate configuration. Similarly, as possibly best seen in FIGS. 2 and 3, transverse body portion 140 is also formed as to have its free edge preferably of an arcuate configuration. Preferably, the basket means 138 is formed of a suitable metal such as, for example, aluminum. As best seen in FIGS. 10 and 11, in the preferred embodiment body portion 142, retainer means 126 and 128, latching finger member 136 and slot-like opening 132 of latching means 130 are all located at the same side of the pole 116 and, further, the general plane of the free edge of body portion 142 is at least generally parallel to the functional axis determined by the upper retainer means 126 and 128.

As best seen in FIG. 12, the hand grip 118 is provided with an internal slot or opening 144 which has suitable flatted surface means as to thereby function as keying means the purpose of which is to be described.

The right-hand ski pole assembly 28 as depicted in, for example, FIGS. 15 and 16 may be considered the mirror image of left-hand ski pole assembly 30 and the elements of the right-hand ski pole assembly 28 which correspond to those elements heretofore specifically discussed, as with reference to FIGS. 10, 11 and 12, are identified with like reference numbers provided with a suffix "a".

Referring primarily to FIGS. 13 and 14, the left-hand wing panel 36 is depicted as preferably comprising a suitable fabric portion 146 which at its aerodynamic inner end 148 is preferably substantially wider than at its aerodynamic outer or wing tip end 150. The leading edge 152 of the wing panel fabric 146 is preferably aerodynamically swept back a relatively lesser amount while the trailing edge 154 is preferably aerodynamically swept forwardly a relatively greater amount. As generally depicted in FIG. 13 the peripheral portion of the wing fabric 146 may be provided with a suitable hem-like portion as generally depicted by stitching 156.

As generally depicted in FIG. 14, the upper end 148 of the wing fabric 146 is preferably formed into an open loop, having an inner opening or passage 158, as by suitable stitching 160. The fabric wing tip 150 is provided with retainer means 162 which, preferably, comprises a sturdy channel member of suitable material such as, for example, aluminum, having a first leg portion 164 and a second leg portion 166. The first leg portion 164 of the generally U-shaped channel-like member 162 may be secured to the wing fabric 146, as at its tip area, by any suitable means as, for example, a suitable bonding or adhesive among which is an epoxy cement. As depicted in FIG. 14, when the first leg portion 164 is fixedly secured to the fabric 146, a space exists as between the secured fabric portion and the second leg portion 166 of retainer 162. In the preferred embodiment, the length of the wing tip retainer means 162 is such as extend over at least a major length or portion of the fabric wing tip 150.

Near the inner end of the wing panel 36, a plurality of openings 168 and 170 are preferably formed as through at least the upper portion of the fabric 146 forming the loop at 148 of the panel 36.

The loop opening or passage 158 is adapted to receive therein a preferably tubular cylindrical member 172, as depicted in FIG. 13, the axial length of which is preferably sufficient to permit the ends thereof to extend some distance beyond the leading and trailing edges, 152 and 154, of the wing panel fabric 146.

Referring now also to FIGS. 17 and 18, the left wing panel 36 is operationally secured to the left ski pole assembly 30 as by first inserting the depending body portion 142, of basket means 138, into the end retainer or channel member 162 as to be generally between the leg portions 164 and 166. The wing fabric 146 is then urged, and somewhat stretched or tensioned, toward the cross-member 122 while at the same time passing the inboard end 148 generally between the ski pole 116 and retainers 126 and 128. When the thusly tensioned wing fabric 146 is so positioned as to have cut-out portions or apertures 168 and 170 respectively in general registry with retainers 126 and 128, the tubular member 172 (along with the wing fabric 146 carried thereby) is urged toward such retainers 126 and 128 as to result in retainers 126 and 128 respectively passing through openings 168 and 170 and operatively engaging tubular member 172 in the depicted locked assembled configuration. At this time, of course, the depending end of basket body portion 142 is in abutting relationship with the bight portion of wing tip panel retainer means 162. As generally illustrated in FIG. 17, the left ski wing assembly 40 may be provided with suitable strap means 174 and 176 which may be detachably secured as by suitable snaps or the like to the wing tip retainer 162.

The right wing assembly 38 is comprised of a ski wing panel 34 which may be considered as a mirror image of the left ski wing panel 36 of FIGS. 13, 14, 17 and 18. All elements of the right wing assembly 38 (as appear in, for example, FIGS. 15, 16, 19, 20 and 21), which are like or similar to those hereinbefore specifically discussed with reference to FIGS. 13, 14, 17 and 18, are identified with like reference numbers provided with a suffix "a". Further, in constructing or assembling the right wing assembly 38, the procedure would be as that already described with reference to the left wing assembly 40.

Figure 19:
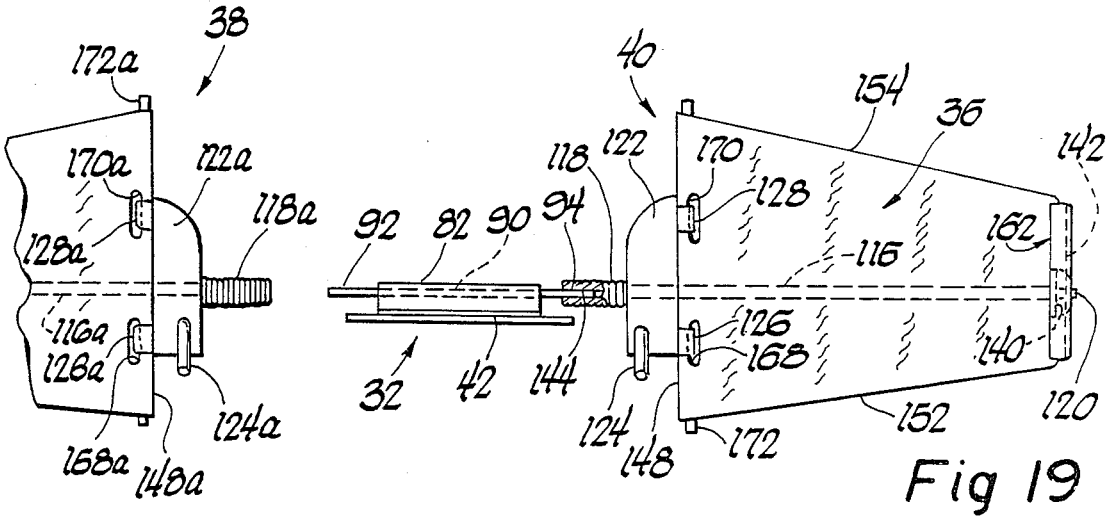
FIG. 19 is a top plan view of the left and right wing assemblies and a harness plate with the left wing assembly being partially operationally connected to the harness plate and the fragmentarily illustrated right wing assembly being detached from the harness plate.
Figure 20:
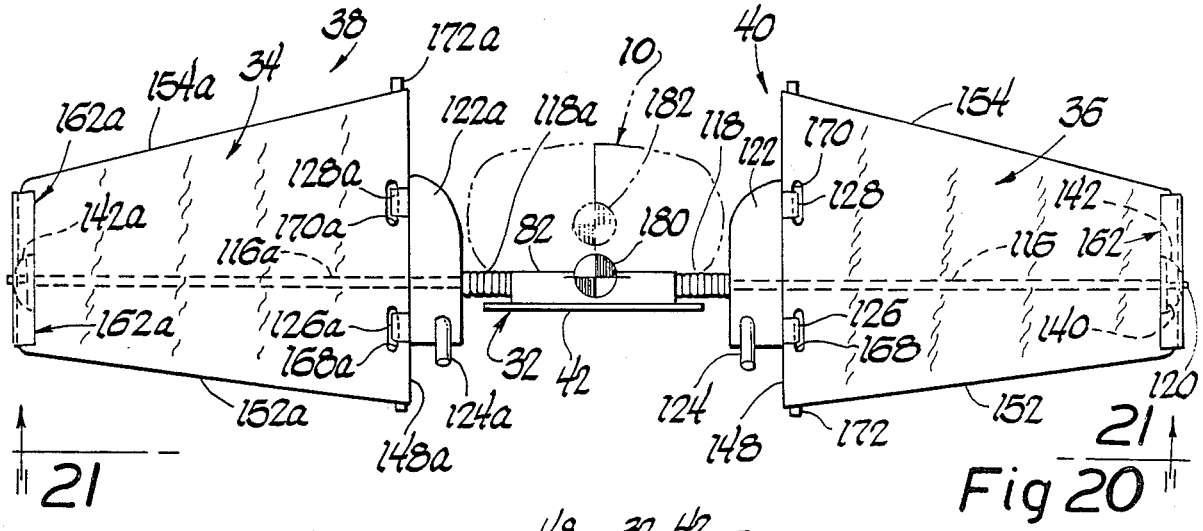
FIG. 20 is a top plan view of the wing assemblies and harness plate of FIG. 19 in an assembled condition.
Figure 21:
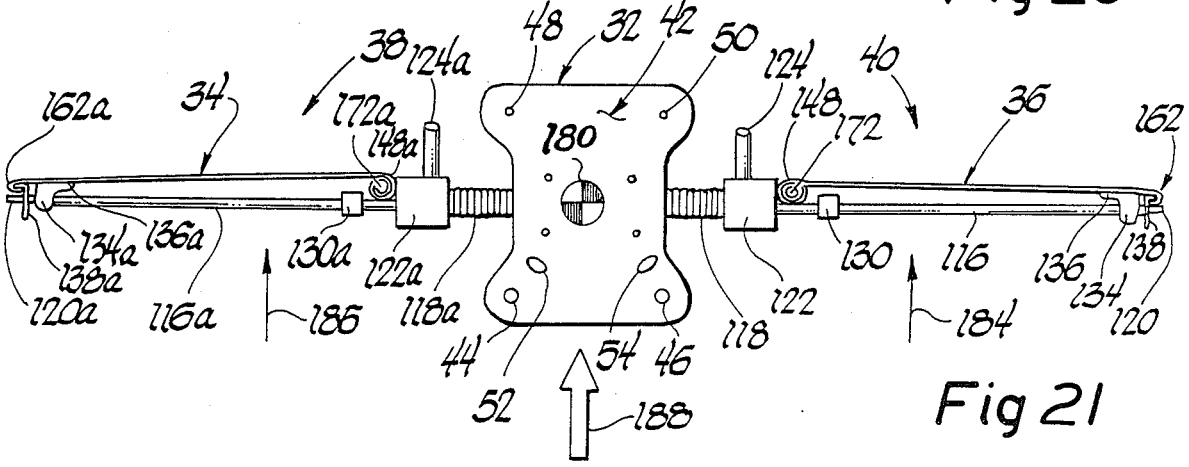
FIG. 21 is a view taken generally on the plane of line 21—21 of FIG. 20 and looking in the direction of the arrows.

Referring in greater detail to FIGS. 19, 20 and 21, once the left and right wing assemblies 40 and 38 are completed, they may be operatively connected to the harness means 32. More particularly, FIG. 19 depicts having the torsion bar extension portion 94 partly received in the cooperating slot or opening 144 of the hand grip 118. Upon further axial movement (axially of the ski pole shaft 116) of the wing assembly 40 toward the harness means 32, the torsion bar extension 94 will be operatively fully received in cooperating slot 144 and the wing assembly 40 will assume a relative position as generally depicted in FIG. 20. FIG. 19 also fragmentarily illustrates the right wing assembly 38 which is approaching operative engagement with the opposite torsion bar extension 92. When the wing assembly 38 is operatively engaged with the harness means 32, by having the torsion bar extension 92 operatively fully received in cooperating slot **144*a*, the right wing assembly 38 will assume a relative position as generally depicted in FIG. 20**.

As generally illustrated in FIG. 21, the aerodynamic force experienced by the left wing assembly 40, represented by arrow 184, and the aerodynamic force experienced by the right wing assembly 38, represented by arrow 186, are transmitted via torsion bar means 90 to the harness means 32 as to have a resultant aerodynamic lifting force, represented by arrow 188, passing as through the center of gravity 180 of the harness means 32. As somewhat simplistically illustrated in FIG. 20, the center of gravity (and center of lift action) 180 is closely spaced from the center of gravity 182 of the skier's body 10 as when the skier is in a upright stance.

As already hereinbefore indicated, the extensions 92 and 94 provide for operative connection between the harness assembly 32 and right and left wing assemblies 38 and 40, respectively. Further, in the preferred embodiment the slots or recesses 144 and **144*a* are so formed as to provide for a keying means function with torsion bar means 90 and more particularly with torsion bar extensions 94 and 92, respectively. By so doing the wing assemblies 38 and 40, once assembled to the harness means 32, assume substantially the same angular inclination (about the axes of pole shafts 116 and 116*a*) as with respect to, a common plane of reference as, for example, the breast plate 42. Further, as should be evident as from, for example, FIGS. 19, 20 and 21, the axis of left wing assembly 40, as determined by ski pole shaft 116, is in substantial co-linear alignment with the axis of right wing assembly 38, as determined by ski pole shaft 116***a*. Similarly, such axes are preferably in co-linear alignment with the axes of keying slots 144 and 144*a* as well as with torsion bar extensions 92 and 94.

Operation of the Invention

FIG. 4 depicts the skier 10 with the harness means 32 and wing assemblies 38 and 40 operatively connected thereto with such connections being made as described with reference to FIGS. 19, 20 and 21. As generally illustrated, the skier's right forearm is in general juxtaposition to the cross-member 122*a* and the skier's right hand is grasping the auxiliary right control means or handle 124*a*. Similarly, the skier's left forearm is in general juxtaposition to the cross-member 122 and the skier's left hand is grasping the auxiliary left control means or handle 124.

As generally depicted in FIGS. 4 and 22, the wing assemblies 38 and 40, when attached to the harness means 32 and with the skier standing upright on a level horizontal surface or plane, may be so positioned in a normal or null position as to have their respective leading and trailing edges in a zero-degree angle of attack which, as is well known, is that angle which the chord of the wing airfoil assumes with respect to the apparent wind. However, as a further assistance and benefit to the skier, in the preferred embodiment of the invention the torsion bar means 90, and in particular torsion bar extensions 92 and 94, along with the keying slots 144 and 144*a* are so positioned, relative to the chord of the airfoils of wing assemblies 38 and 40 as to result in a normal, null or home position of the wing assemblies 38 and 40 providing some preselected positive angle of attack such as, for example, in the order of 6° as depicted in FIGS. 22, 23 and 24 and as indicated at 190 and 192 of FIGS. 23 and 24. Arrows 194 and 196 respectively diagrammatically depict the aerodynamic lift and drag created with the skier 10 making a downhill run with the wing assemblies 38 and 40 being at a positive angle of attack as, for example, a preselected magnitude of 6°.

In the preferred embodiment of the invention, the skier, as while making a downhill run, may rotate the left and right wing assemblies 40 and 30 (about their axes) independently of each other merely by either pulling back or pushing forward upon auxiliary control means or levers 124 and 124*a*. While doing so, the skier need not worry about how far the skier must move or rotate the wing assemblies in order to again return to the home or null position because by merely relieving the effort applied to the control levers or handles 124 and/or 124*a*, the torsion bar extensions 94 and 92 will resiliently torsionally rotate the wing assemblies 40 and 38 to their preselected null or home position.

As generally depicted in FIGS. 25, 26 and 27, the invention enables the skier to also provide for differing angles of attack for the opposite wing assemblies. For example, in FIG. 25 the skier 10 is shown as having pulled-back on the control means 124*a* as to result in the right wing assembly 38 assuming a condition wherein the angle of attack, as indicated at 198 of FIG. 26, is substantially greater than that depicted at 190 of FIG. 23. The heavy arrows in FIG. 26 depict the apparent wind creating the resultant aerodynamic lift 200 and drag 202. At the same time the skier 10 is shown having pushed forwardly the control means or lever 124 thereby causing a condition, in the left wing assembly 40, wherein the angle of attack, as indicated at 204 of FIG. 27, has become a negative angle of attack (creating no aerodynamic lift) resulting in high aerodynamic drag and no lift. The heavy arrows in FIG. 27 depict the apparent wind creating the resultant drag 206 and negative lift 208.

When the skier 10 selectively positions the wing assemblies as generally depicted in FIG. 25 the created drag (with no lift) of the left wing 40 acts as an aerodynamic brake and affects the radius of gyration of the skier thereby assisting the skier to go into a left turn motion or maneuver because the right wing assembly 38 still has a better or greater forward momentum than the left wing assembly 40 and such right wing assembly 38, at least momentarily, provides a greater up-lift to the skier. All of such forces along with the skier's skillful body shifts and movements combine to give the skier easier and better turning power than the skier could obtain from the assist obtained from merely ski pole planting in the usual technique employed by skiers with prior art equipment as depicted, for example, in FIG. 1.

A skier employing the invention manipulates the changing of the angles of attack of the wing assemblies mainly for the purposes of initiating turns or, at certain times, slowing the skier's speed. In order to thusly manipulate or variably position the wing angles of attack, the skier has to manually overcome the resilient resistance provided by the torsion bar means 90 which is operatively secured to and carried by the plate or body means 42 of the harness means 32. The resilient resistance provided by the torsion bar or spring means 90 and sensed by the skier results in the skier quickly learning the "feel" of how much the skier has either increased or decreased the angle of attack from the null or preset angle of attack. Further, the skier quickly learns that all the skier must do to return to a normal path, after completing a turn, is to relax the skier's arm muscles and let the resilient force of the spring means 90 return the wing assemblies to their even preset angle of attack position.

Figure 7:
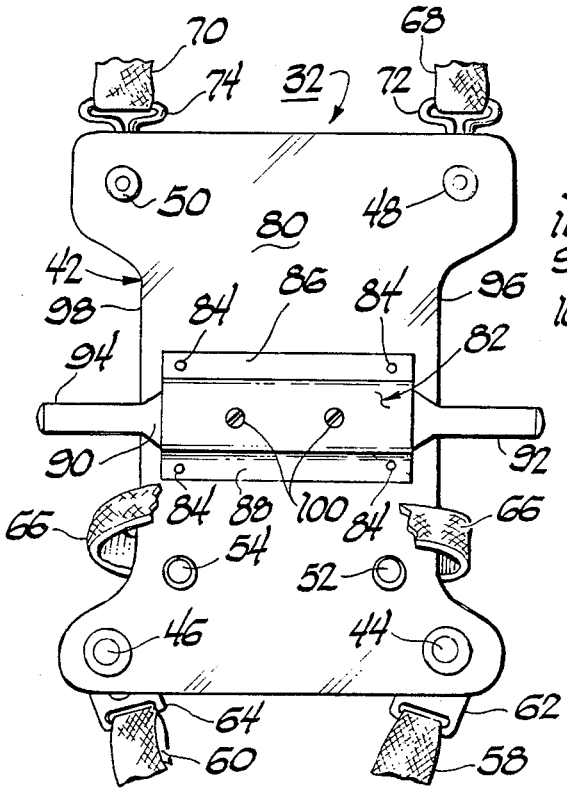
FIG. 7 is a view taken generally on the plane of line 7—7 of FIG. 6 and looking in the direction of the arrows.

As already indicated, as in FIGS. 5 and 7, the width of the harness breast plate or body 42 is reduced as at cut-out portions 96 and 98. This, in turn, enables the outer or top ends of the hand grips 118 and 118*a* to be brought further inwardly toward each other when the wing assemblies 40 and 38 are brought into full operating engagement with torsion bar means 90 thereby increasing the axial length of engagement as between torsion spring extensions 92 and 94 and the cooperating slots 144*a* and 144 of grips 118*a* and 118. Further, with such an arrangement it is possible to have the torsion bar extensions 92 and 94 not extending, transversely of the skier's body, a distance which would hinder the free movement of the skier's arms when wearing the harness means but not having the wing assemblies 38 and 40 operatively connected to such harness means 32.

As previously stated, the harness means 32 when worn by the skier preferably locates the torsion bar or spring means 90 immediately below the skier's rib cage as to be generally pressed against the skier's abdomen thereby tending to bring the center of gravity 180 (and center of action) of the harness assembly 32 and wings 38 and 40 into coincidence with the center of gravity 182 of the skier's body. With the foregoing in mind, it becomes apparent that during use the lift and drag forces created by the left and right wing assemblies are transmitted via the cooperating torsion bar means 90 toward the center of action or gravity 180 of the harness means 32 and, in turn, re-applied or directed toward the skier's body center of gravity 182 which may be somewhat higher but still in close proximity to the center of gravity 180 of harness means 32.

Figure 28:
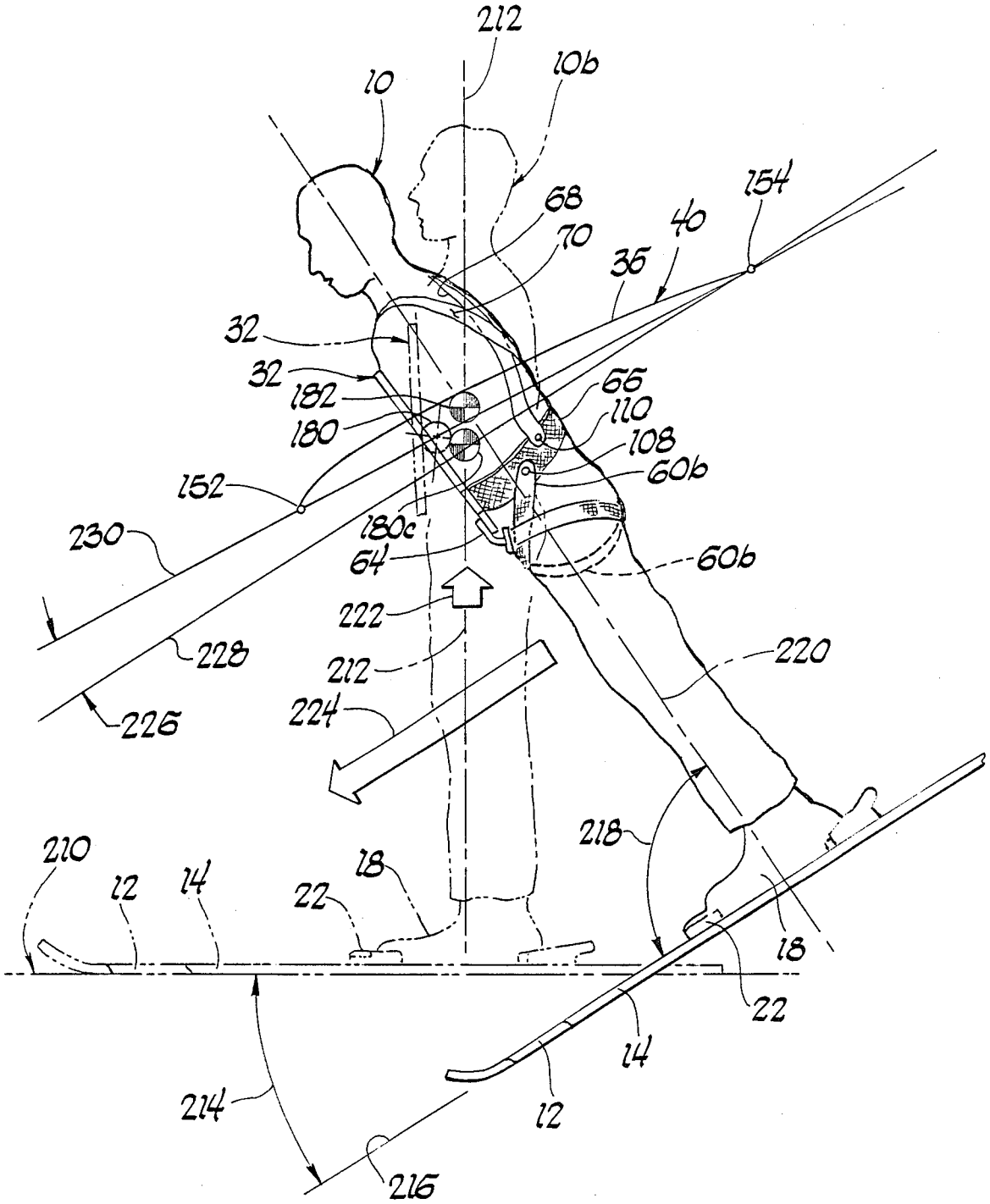
FIG. 28 is somewhat a schematic side view of a skier, positioned generally perpendicular to the slope of a downhill ski run, having selectively positioned the wing assemblies as to obtain aerodynamic lift force.

To better understand the respective centers of gravity and their interrelationships reference is now made to FIG. 28 which schematically illustrates, in phantom line at **10*b*, the skier standing on flat terrain and not in motion and, in solid line at 10**, the skier on a downhill run and in motion.

Referring to FIG. 28, when standing still on a flat terrain and with the skier's skis 12 and 14 in or on a horizontal plane 210, the vertical axis 212 of the skier shows that the skier's basic center of gravity 182 is above the skier's hips whereas the center of gravity 180 of the harness means 32 and attached wings 38 and 40 is somewhat lower and more forwardly disposed as to be slightly above the skier's hips and waist belt height. The next considered condition or position is that of skier 10 depicted as in motion downhill on a slope of, for example, 30° as indicated at 214.

When the skier 10 moves down such a slope the skier can assume a position of generally 90°, as indicated at 218, with respect to the fall line 216 of such slope. Therefore, the skier's major axis 220, corresponding to axis 212 of skier **10*b*, still passes through the skier's body center of gravity 182. However, an interesting change of relative location of the center of gravity 180 occurs when the skier 10*b* is in a downhill motion. That is, because the center of gravity 180 (of the harness and wings) is somewhat lower and slightly forward of the skier's center of gravity 182 when the skier is in the position of 10*b*, such center of gravity 180 shifts, much as a pendulum to a new relative position, depicted at 180*c*, just below the skier's center of gravity 182 when the skier assumes a generally downhill position as generally depicted by 10. This general coincidence of centers of gravity (180*c* and 182) provided by the invention results in a significant advantage because, as it can be seen in FIG. 28, the sum of the generated lift forces, depicted by arrow 222 and generated during the skier's downhill run as depicted by arrow 224, substantially coincide with or pass through the skier's own weight reaction thereby resulting in the skier receiving a definite and positive sensation from the drag and lift forces created by the wing assemblies 38 and 40**.

Still considering FIG. 28, the lift effect on the skier 10 can be generally optimal if the wing assemblies are set as to have an angle of attack in the order of 6°, as indicated at 226, with reference line 228 being the direction of the apparent wind paralleling the slope 216 and reference line 230 being the extension of the wing air foil chord. As previously indicated, in the preferred embodiment of the invention the torsion bar means 90 and cooperating slots 144 and **144*a* are preferably preset as to provide such an initial preselected home, normal or null position resulting in a preselected minimal type of positive angle of attack of wing assemblies 38 and 40. Therefore, the skier is not required to manually regulate or position the wing assemblies 38 and 40 into a normal angle of attack. However, because the return spring means or torsion means 90 is resiliently deflectable in both rotary directions about the respective axes of wing assemblies 38 and 40, it is easily possible for the skier to override and change the normal preselected angle of attack of either or both the left and right wing assemblies 40 and 38** and, further, to do so independently with each wing assembly.

Figure 29:
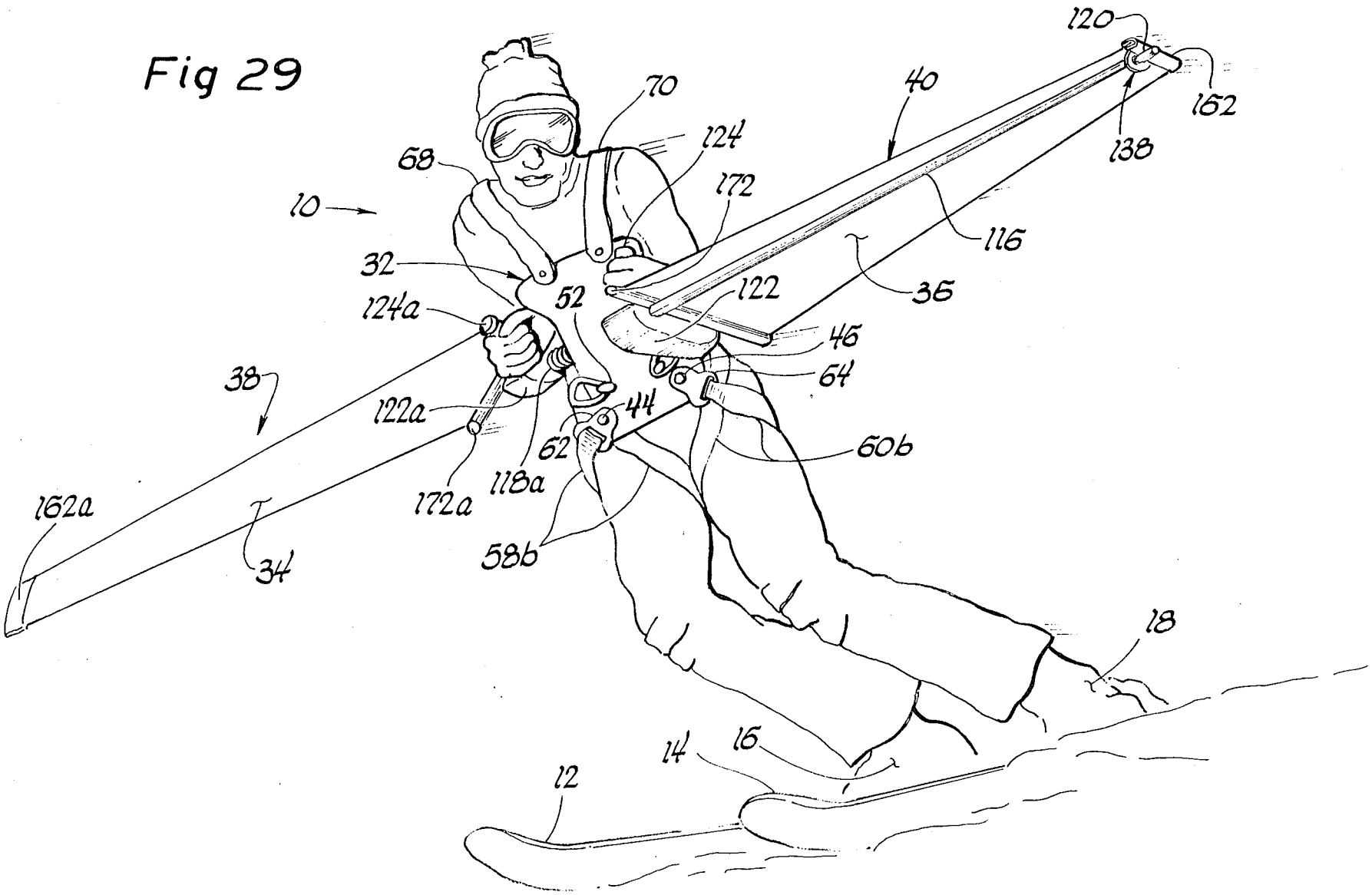
FIG. 29 is an elevational view depicting a skier equipped with wing apparatus, employing teachings of the invention, making a turn to the skier's right while, for example, traveling at maximum speed.

FIG. 29, in the main, depicts a skier 10, with apparatus employing teachings of the invention, on a generally downhill run and progressing into a right turn by having, with the right hand and arm, rotated the control means or lever **124*a* generally forwardly, thereby placing the right wing assembly 38 into a position of negative angle of attack, and with left hand and arm either leaving the left wing assembly 40 in a preselected or normal angle of attack or even rotating the control means or lever 124 generally rearwardly thereby placing the left wing assembly 40** in a position of increased positive angle of attack greater than the said normal angle of attack.

FIGS. 29, 28, 8 and 9 should now be further considered with regard to a somewhat modified manner of securing the harness means 32 to the skier's body.

The harness assembly or means 32 of FIGS. 8 and 9 has been disclosed and described as having lower strap or belt means 58 and 60 which, as described and as illustrated in for example FIGS. 2, 3, 4, 22 and 25, are intended to pass simply between and behind the skier's legs and, when secured, to assume a configuration as generally depicted in FIGS. 8 and 9. In comparison, FIGS. 28 and 29 illustrate a somewhat modified manner of securing the lower straps to the skier's legs. For ease of reference, in FIGS. 28 and 29, the belt or strap means generally functionally equivalent to strap means 58 and 60 of FIGS. 8 and 9 are respectively identified by reference numbers **58*b* and 60*b***.

As typically illustrated by strap or belt means **60*b* in FIGS. 28 and 29, the belt 60*b* is suitably attached as at 108 to the girding belt 66 and then passed generally along and against the outside of the skier's left leg and generally forwardly thereof. The belt 60*b* is then passed along and against the forward portion of the skier's left leg from where the belt 60*b* continues somewhat downwardly and against the inside of the skier's left leg as generally depicted in hidden line. The belt 60*b* then continues behind the skier's left leg, generally somewhat below and against the left buttock, and then against the outer portion of the skier's left leg upwardly to where the end of the strap 60*b* is connected as via latch or clasp means 64 to anchor post 46 (both of which are more clearly shown in FIG. 5). The strap or belt means 58*b* would be applied to and about the skier's right leg in a fashion which may be considered the mirror image of that described with reference to belt or strap means 60*b***.

One of the main benefits of strap means **58*b* and 60*b* is that by effectively wrapping such about respective legs of the skier the overall harness means 32 is much more effectively secured to the skier's body minimizing any relative movement as between the harness assembly 32 and the skier's body. Just as with regard to belt means 58 and 60, so, too, the belt or strap means 58*b* and 60*b* may be suitably permanently or detachably secured to the girding belt 66** (as well as selectively positioned therealong) and may be selectively adjustable for length.

Referring now in greater detail to FIGS. 13, 14, 15, 16, 17, 18 and 3, the invention also provides means whereby a skier after finishing a downhill run, while using the ski wing assemblies 38 and 40, is able to again either alone or by conventional transport go to the top of the ski run or slope. More particularly, the skier would first disconnect the left and right wing assemblies 40 and 38 from the torsion bar means 90 of harness means 32. Next, the skier would disassemble each of the wing assemblies in a manner generally opposite to the assembly of such wing assemblies as described with reference to FIGS. 17 and 18. At this time the skier, who could continue to wear the harness means 32, would have, disassembled from each other: (a) a left wing panel assembly 36; (b) a left ski pole assembly 30; (c) a right wing panel assembly 34 and (d) a right ski pole assembly 28.

Referring in particular to FIGS. 15 and 16, the skier would then take the right wing panel assembly 34 and insert latching finger **136*a* (operatively carried by the ski pole assembly 28) into one of the open ends of tubular member 172*a* and then press the opposite end of tubular member 172*a* into the resiliently openable slot 132*a* of upper disposed latching or retainer means 130*a* thereby effectively detachably securing the tubular member 172*a*, and corresponding end 148*a* of right wing panel assembly 34, to the ski pole shaft 116*a* of the right ski pole assembly 28. Once this is achieved, as generally depicted in FIG. 15, the wing panel assembly 34 is wound or coiled about the ski pole shaft 116*a* until completely wound thereabout as to result in a configuration as generally depicted in FIG. 16. The wound wing panel assembly 34 may be operatively secured in such a stored condition as by suitable strap means 174*a* and 176*a* which may be operatively secured to or detached from the wing panel assembly 34** and, further, may be of the type described as being of a teasel-and-fleece-like construction.

Similarly, the left wing panel assembly 36 would be stored onto the left ski pole assembly 30 in the manner as generally described with reference to the right wing panel assembly 34 and ski pole assembly 28.

As a consequence, the skier 10 would have left and right ski pole assemblies 28 and 30 with wing panel assemblies 34 and 36 respectively stored thereon as generally depicted in FIG. 3. With the wing panel assemblies thusly stored, the skier, still wearing the harness means 32, is clearly able to either on his own to again ascend the ski slope (as by conventional skiing techniques) or to be transported to the top of the ski run as by chair lift, gondola, etc. Further, even if the skier desires to spend some time skiing without using the ski wing assemblies (as in FIG. 4) the skier is able to do so with the stored wing panel assemblies 34 and 36 since such do not significantly restrict the otherwise normal skiing techniques or movements. It is, of course, possible to totally remove the wing panel assemblies and ski conventionally with the ski pole assemblies as generally depicted in FIG. 2.

Even though possible, the primary intent of the invention is not to result in the skier becoming airborne but rather to convey a degree of aerodynamic lift to the skier as to have the skier feel lighter on the skiis and have the sensation of flight.

The invention as herein disclosed and described provides a true sensation of flying on wings even if the skier never leaves the safety of solid ground (snow) contact. Therefore, generally, the wing area may be relatively small and relatively light in weight. Accordingly, such wing structures of the invention being relatively small lend themselves to being made collapsible and easily storable and, further, are quite inexpensive. Also, the wing structures of the invention do not require complicated and dangerous stabilizing controls nor do they cause aerodynamic stall conditions.

As already indicated, the invention provides an auxiliary wing-lifting structure of aerodynamic lift capacity sufficient to apply a lift force to the skier resulting in the skier having a sensation of flying, while moving downhill at various speeds, without the necessity of leaving the safe earth contact, with the skiis or becoming outright airborne. This has the advantage of giving to the skier the sensation of flight without having the skier submit to the great risks attendant airborne flight. Such airborne flight risks are believed to be the main reason why only a relatively few people engage in the sport of hang-gliding.

In an aspect of the invention, the invention provides a harness to efficiently transfer the generated aerodynamic lift forces in the direction of the basic center of gravity of the skier.

Further, in the preferred embodiment, the harness means is provided with oppositely extending torsion bar portions serving as operational connectors for the right and left wing assemblies; such torsion bar portions provide for resilient twisting characteristics relative to the harness means thereby enabling the skier to selectively and independently vary the respective aerodynamic angles of attack for the right and left ski wing assemblies operatively connected to the torsion bar portions.

The invention also provides for ski poles which are employable for forming a portion of the overall ski wing assemblies and when not so rigged are employable to function in the same manner as conventional prior art ski poles.

Further, the invention provides ski poles respectively provided with a sturdy cross piece or member, generally below the usual hand grip of the ski pole shaft, which serves as an arm rest for the skier when the ski poles are rigged to form respective right and left ski wing assemblies; a second hand grip also carried as by each of the cross piece members serves, by movement thereof, to selectively alter the aerodynamic angles of attack of the associated ski wing assembly.

In still another aspect of the invention, the cross piece or member carries tension holding and latching or retainer means whereby the associated wing panel assembly can be secured so that the air foil of the resulting ski wing assembly always functions adequately.

Also, in another aspect of the invention, once the respective ski wing panel assemblies are disconnected from the ski pole assemblies (that is, from its ski wing assembly configuration), the ski wing panel assembly can be stored on the ski pole as by wrapping the ski wing panel about the ski pole shaft, and suitably secured to maintain a stored condition, thereby enabling such ski poles with stored ski wing panel assemblies to be employed as conventional prior art ski poles.

Still further another aspect of the invention provides for a harness assembly having a frontal breast plate which is sufficiently sturdy to operationally carry a crosswise torsion bar mounted to such breast plate and wherein all necessary harness belting, webbing and attachment hardware are removably attachable to the breast plate.

Although only a preferred embodiment and selected modifications of the invention have been disclosed and described, it is apparent that other embodiments and modifications of the invention are possible within the scope of the appended claims.

What is claimed is:

1. Apparatus for creating aerodynamic lift to a downhill skier, comprising harness means adapted to be worn by said skier, a left wing structure operatively carried by said harness means, a right wing structure operatively carried by said harness means, connecting means carried by said harness means for operatively connecting said left wing structure as to thereby have said left wing structure operatively carried by said harness means and for operatively connecting said right wing structure as to thereby have said right wing structure operatively carried by said harness means, said left wing structure having a first longitudinal axis extending generally transversely of said skier, said right wing structure having a second longitudinal axis extending generally transversely of said skier, wherein said connecting means enables said left wing structure to be selectively rotatable about said first longitudinal axis while operatively carried by said harness means, wherein said connecting means enables said right wing structure to be selectively rotatable about said second longitudinal axis while operatively carried by said harness means, wherein said connecting means enables said left and right wing structures to be respectively rotatable about said first and second axes independently of each other by said skier to respective selected positions while operatively carried by said harness means, wherein said connecting means is effective for establishing and maintaining a fixed relationship of said first longitudinal axis with respect to said harness means even during rotation of said left wing structure about said first longitudinal axis, and wherein said connecting means is effective for establishing and maintaining a fixed relationship of said second longitudinal axis with respect to said harness means even during rotation of said right wing structure about said second longitudinal axis.

2. Apparatus for creating aerodynamic lift to a downhill skier according to claim 1 wherein said connecting means comprises resilient means, said resilient means being resiliently deflectable in at least two directions of motion, and wherein when said left wing structure is selectively rotated in a first direction about said first longitudinal axis said resilient means resiliently urges said left wing structure in a second direction about said first longitudinal axis opposite to said first direction.

3. Apparatus for creating aerodynamic lift to a downhill skier according to claim 2 wherein said resilient means comprises torsion bar means.

4. Apparatus for creating aerodynamic lift to a downhill skier according to claim 1 wherein said connecting means comprises resilient means, said resilient means being resiliently deflectable in at least two directions of motion, and wherein when said right wing structure is selectively rotated in a first direction about said second longitudinal axis said resilient means resiliently urges said right wing structure in a second direction about said second longitudinal axis opposite to said first direction.

5. Apparatus for creating aerodynamic lift to a downhill skier according to claim 4 wherein said resilient means comprises torsion bar means.

6. Apparatus for creating aerodynamic lift to a downhill skier according to claim 1 wherein said connecting means comprises torsion bar means, said torsion bar means being resiliently torsionally deflectable in at least two directions of motion, wherein when said left wing structure is selectively rotated in a first direction about said first longitudinal axis said torsion bar means resiliently urges said left wing structure in a second direction opposite to said first direction about said first longitudinal axis, and wherein when said right wing structure is selectively rotated in a first direction about said second longitudinal axis said torsion bar means resiliently urges said right wing structure in a second direction about said second longitudinal axis opposite to said first direction about said second longitudinal axis.

7. Apparatus for creating aerodynamic lift to a downhill skier according to claim 6 wherein said torsion bar means comprises a single torsion bar operatively carried by said harness means.

8. Apparatus for creating aerodynamic lift to a downhill skier according to claim 2 wherein said resilient means is preset to establish a normal null position of said left wing structure, and wherein when said skier effectively releases said left wing structure after having selectively rotated said left wing structure in said first direction said resilient means is permitted to rotate said left wing structure in said second direction toward said normal null position.

9. Apparatus for creating aerodynamic lift to a downhill skier according to claim 4 wherein said resilient means is preset to establish a normal null position of said right wing structure, and wherein when said skier effectively releases said right wing structure after having selectively rotated said right wing structure in said first direction said resilient means is permitted to rotate said right wing structure in said second direction toward said normal null position.

10. Apparatus for creating aerodynamic lift to a downhill skier according to claim 6 wherein said torsion bar means is preset to establish a first normal null position of said left wing structure and a second normal null position of said right wing structure, wherein when said skier effectively releases said left wing structure after having selectively rotated said left wing structure in said first direction about said first longitudinal axis said torsion bar means is permitted to rotate said left wing structure in said second direction about said first longitudinal axis toward said first normal null position, and wherein when said skier effectively releases said right wing structure after having selectively rotated said right wing structure in said first direction about said second longitudinal axis said torsion bar means is permitted to rotate said right wing structure in said second direction about said second longitudinal axis toward said second normal null position.

11. Apparatus for creating aerodynamic lift to a downhill skier according to claim 10 wherein said first normal null position and said second normal null position are functionally equivalent so that when said left and right wing structures are in their respective first and second normal null positions said left and right wing structures are in substantial aerodynamic alignment with each other.

12. Apparatus for creating aerodynamic lift to a downhill skier according to claim 6 wherein said left wing structure is operatively connected to and supported by said torsion bar means in a cantilever-like fashion, and wherein said right wing structure is operatively connected to and supported by said torsion bar means in a cantilever-like fashion.

13. Apparatus for creating aerodynamic lift to a downhill skier according to claim 6 wherein said left wing structure is supported by and detachably secured to said torsion bar means, and wherein said right wing structure is supported by and detachably secured to said torsion bar means.

14. Apparatus for creating aerodynamic lift to a downhill skier according to claim 1 wherein said first and second longitudinal axes are in substantial axial alignment with each other.

15. Apparatus for creating aerodynamic lift to a downhill skier according to claim 2 wherein said first and second longitudinal axes are in substantial axial alignment with each other.

16. Apparatus for creating aerodynamic lift to a downhill skier according to claim 4 wherein said first and second longitudinal axes are in substantial axial alignment with each other.

17. Apparatus for creating aerodynamic lift to a downhill skier according to claim 6 wherein said first and second longitudinal axes are in substantial axial alignment with each other.

18. Apparatus for creating aerodynamic lift to a downhill skier according to claim 6 wherein said torsion bar means comprises a third longitudinal axis, and wherein said first second and third longitudinal axes are in substantial axial alignment with each other.

19. Appratus for creating aerodynamic lift to a downhill skier according to claim 1 wherein said harness means comprises a substantially rigid breast plate member intended to be worn as against a forward portion of said skier's torso, attachment means for securingly holding said breast plate member against said forward portion of said skier's torso, and wherein said connecting means comprises resiliently deflectable torsion bar means operatively secured to said breast plate member, and wherein said left and right ski wing structures are each adapted for operative connection to said torsion bar means.

20. Apparatus for creating aerodynamic lift to a downhill skier according to claim 19 wherein said torsion bar means is situated with respect to said breast plate member as to be positioned generally between said breast plate member and said forward portion of said skier's torso when said breast plate member is worn against said forward portion of said skier's torso.

21. Apparatus for creating aerodynamic lift to a downhill skier according to claim 19 said attachment means comprises first and second flexible strap means each of which is operatively connected to said rigid breast plate member, wherein said first strap means passes from the breast plate member between the skiers legs and then around and behind the skier's left leg, and wherein said second strap means passes from the breast plate member between the skier's legs and then around and behind the skier's right leg.

22. Apparatus for creating aerodynamic lift to a downhill skier according to claim 21 wherein said attachment means further comprises first and second flexible shoulder strap means each of which is operatively connected to said rigid breast plate member, and wherein said first and second shoulder strap means respectively engage the left and right shoulders of said skier.

23. Apparatus for creating aerodynamic lift to a downhill skier according to claim 22 said attachment means further comprises flexible girding type strap means operatively connected to said rigid breast plate member and generally passing around the back of said skier's torso at least in the vicinity of said skier's waist.

24. Apparatus for creating aerodynamic lift to a downhill skier according to claim 23 wherein said first and second flexible strap means at respective first ends thereof are directly connected to said rigid breast plate member, and wherein said first and second flexible strap means at respective second ends thereof are operatively connected to said rigid breast plate member by being directly connected to said girding type strap means.

25. Apparatus for creating aerodynamic lift to a downhill skier according to claim 23 said first and second shoulder strap means at respective first ends thereof are directly connected to said rigid breast plate member, and wherein said first and second shoulder strap means at respective second ends thereof are operatively connected to said rigid breast plate member by being directly connected to said girding type strap means.

26. Apparatus for creating aerodynamic lift to a downhill skier according to claim 19 wherein said attachment means comprises first and second flexible constraining mean operatively connected to said rigid breast plate member, wherein said first flexible constraining means substantially encircles and girdles said skier's left leg, and wherein said second flexible constraining means substantially encircles and girdles said skier's right leg.

27. Apparatus for creating aerodynamic lift to a downhill skier according to claim 1 wherein said left wing structure comprises a first outboard end and a first inboard end with said first inboard end being effective to be operationally situated relatively closer to said harness means than said first outboard end, wherein said left wing structure comprises manually engageable first control means situated at least near said first inboard end and engageable by the skier's left hand in order to thereby selectively rotate said left wing structure about said first longitudinal axis, wherein said right wing structure comprises a second outboard end and a second inboard end with said second inboard end being effective to be operationally situated relatively closer to said harness means than said second outboard end, and wherein said right wing structure comprises manually engageable second control means situated at least near said second inboard end and engageable by the skier's right hand in order to thereby selectively rotate said right wing structure about said second longitudinal axis.

28. Apparatus for creating aerodynamic lift to a downhill skier according to claim 27 wherein said first and second control means respectively comprise first and second lever-like means.

29. Apparatus for creating aerodynamic lift to a downhill skier according to claim 1 wherein said left wing structure comprises longitudinally extending first shaft means having functional first and second end portions, wherein said first end portion comprises a first hand grip portion for engagement by the skier's left hand, wherein said second end portion comprises first attachment means, second attachment means operatively carried by said first shaft means at a location generally near said first hand grip portion, a first flexible fabric-like wing panel having first inboard and first outboard ends and having first leading and first trailing edges, wherein said first outboard end of said first flexible wing panel is operatively connected to and retained by said first attachment means, wherein said first inboard end of said first flexible wing panel is operatively connected to said second attachment means with said first leading edge and said first trailing edge both extending generally from said first outboard end to said first inboard end for creating a left air foil, wherein said right wing structure comprises longitudinally extending second shaft means having functional third and fourth end portions, wherein said third end portion comprises a second hand grip portion for engagement by the skiers right hand, wherein said fourth end portion comprises third attachment means, fourth attachment means operatively carried by said second shaft means at a location generally near said second hand grip portion, a second flexible fabric-like wing panel having second inboard and second outboard ends and having second leading and second trailing edges, wherein said second outboard end of said second flexible wing panel is operatively connected to and retained by said third attachment means, and wherein said second inboard end of said second flexible wing panel is operatively connected to said fourth attachment means with said second leading edge and said second trailing edge both extending from said second outboard end to said second inboard end for creating a right air foil.

30. Apparatus for creating aerodynamic lift to a downhill skier according to claim 29 wherein when said first flexible wing panel is operatively connected to said first and said second attachment means said first flexible wing panel is tensioned in a direction generally paralleling said longitudinally extending first shaft means, and wherein when said second flexible wing panel is operatively connected to said third and fourth attachment means said second flexible wing panel is tensioned in a direction generally paralleling said longitudinally extending second shaft means.

31. Apparatus for creating aerodynamic lift to a downhill skier according to claim 29 wherein said first longitudinally extending shaft means comprises first retainer means, wherein when said first flexible wing panel is detached from said first and second attachment means said first retainer means is effective to operatively retain said first inboard end in a retained condition generally along said first shaft means for enabling said first flexible wing panel to be wound about said first shaft means, wherein said second longitudinally extending shaft means comprises second retainer means, and wherein when said second flexible wing panel is detached from said third and fourth attachment means said second retainer means is effective to operatively retain said second inboard end in a retained condition generally along said second shaft means for enabling said second wing panel to be wound about said second shaft means.

32. Apparatus for creating aerodynamic lift to a downhill skier according to claim 29 wherein said second attachment means comprises a first cross-member carried by said first longitudinally extending shaft means as to be generally transversely situated with respect to said first longitudinally extending shaft means, wherein said fourth attachment means comprises a second cross-member carried by said second longitudinally extending shaft means, and further comprising first control means for use by said skier for selectively rotating said left wing structure about said first longitudinal axis, second control means for use by said skier for selectively rotating said right wing structure about said second longitudinal axis, wherein said first and second control means respectively comprise first and second manually engageable lever means, wherein said first lever means is carried by said first cross-member, and wherein said second lever means is carried by said second cross-member.

33. Apparatus for creating aerodynamic lift to a downhill skier according to claim 29, wherein said connecting means comprises torsion bar means extending generally transversely of said skier, wherein said first hand grip portion comprises first keying means, wherein said second hand grip portion comprises second keying means, wherein said left wing structure is operationally engageable with said torsion bar means by having said torsion bar means and said first keying means operatively connected to each other in a keyed relationship, and wherein said right wing structure is operationally engageable with said torsion bar means by having said torsion bar means and said second keying means operatively connected to each other in a keyed relationship.

* * * * *

UNITED STATES PATENT AND TRADEMARK OFFICE

CERTIFICATE OF CORRECTION

PATENT NO. : 4,756,555

DATED : July 12, 1988

INVENTOR(S) : William V. Bachmann

It is certified that error appears in the above-identified patent and that said Letters Patent is hereby corrected as shown below:

Claim 21, line 2 thereof, between "claim 19" and "said" insert --- wherein ---.

Claim 23, line 2 thereof, between "claim 22" and "said" insert --- wherein ---.

Claim 25, line 2 thereof, between "claim 23" and "said" insert --- wherein ---.

Signed and Sealed this

Thirteenth Day of December, 1988

*Attest:*

DONALD J. QUIGG

*Attesting Officer*

*Commissioner of Patents and Trademarks*